United States Patent [19]

Yen

[11] Patent Number: 4,649,573

[45] Date of Patent: Mar. 17, 1987

[54] GARMENT PATTERN AND ARTICLE OF CLOTHING

[76] Inventor: Su Y. S. Yen, 13 Lane 30, Kin Hwa Street, Taipei, Taiwan

[21] Appl. No.: 736,118

[22] Filed: May 20, 1985

[51] Int. Cl.[4] ..... A41D 11/00

[52] U.S. Cl. ..... 2/74; 2/83; 2/108; 2/115; 2/75

[58] Field of Search ..... 2/75, 83, 80, 108, 105, 2/74, 115, 243 R, 243 B

[56] References Cited

U.S. PATENT DOCUMENTS

| | | | |
|---|---|---|---|
| 1,256,736 | 2/1918 | Sheehy | 2/80 |
| 1,292,703 | 1/1919 | Carter | 2/80 |
| 1,797,604 | 3/1931 | Burgdorfer | 2/75 |
| 2,437,988 | 3/1948 | Artzt | 2/80 |
| 2,671,220 | 3/1954 | Geissmann | 2/80 |
| 3,435,461 | 4/1969 | Artzt | 2/83 |
| 4,257,127 | 3/1981 | Kaupin et al. | 2/75 |

FOREIGN PATENT DOCUMENTS

| | | | |
|---|---|---|---|
| 1460026 | 2/1969 | Fed. Rep. of Germany | 2/75 |

*Primary Examiner*—H. Hampton Hunter
*Attorney, Agent, or Firm*—McAulay, Fields, Fisher, Goldstein & Nissen

[57] ABSTRACT

A pattern for an article of clothing such as a jacket which can be cut from a generally rectangular piece of cloth which includes a pair of foldable identical sections; each section having a lower part and an upper part, the upper part being adapted to form a sleeve and part of a collar for the article; each section being separated from the other beyond its upper end by a neck opening; the narrower lower parts being integral with the upper parts to form the body of the article except for a single cut extending across the breast area of the lower parts of the pattern to the outer end thereof; and an article of clothing made following the pattern, the article being made by folding the upper sections and sewing their extremities to the upper end of the cuts by a single seam. Cloth left over after cutting above and below the upper parts can be used to make one or more pockets, collar facing and the like.

20 Claims, 5 Drawing Figures

GARMENT PATTERN AND ARTICLE OF CLOTHING

BACKGROUND OF THE INVENTION

This invention relates generally to a novel pattern for cutting garments and garments made by following the pattern.

More particularly, the invention is concerned with garments such as blouses, jackets, coats or any equivalent upper garment and the like; and, this invention also relates to a pattern of the character described which can be used to make garments with a minimum of seams and in particular a single seam for each half-section and at the same time to economize on material as well as time.

In the mass production of clothing, speed of fabrication and minimizing use of material are main elements conducive to profitable economic productions. Generally, the speed of fabrication of the garment is adversely affected by the large number of seams which must be sewn to form the garment. Concomitantly, the greater the number of seams which is included in a garment, the greater the number of possible defects due to flawed seams and improper sewing which can occur and lead to rejects.

With regard to material savings, the proper layout of patterns is often neglected in that provisions are not made for using the excess material cut away from the cloth in the finished garment. Moreover, great effort and time is usually spent by the pattern maker and layout person to have the least amount of material wastage.

SUMMARY OF THE INVENTION

The invention is primarily concerned with the making of an outer upper garment in which a single seam is used to form each sleeve and to provide an appropriate shape to the front of the garment by extending the single seam across the front of the garment from the sleeve. In addition, with the appropriate layout of the material onto a pattern in accordance with the teachings of this invention, it is possible to have a single cut made into each half section of the garment which forms a mirror image of each other and to form the sleeve by sewing two portions together to form a tube with a single seam while extending the seam to the front portion and forming and shaping the front portion of each half section with the back section being seamless and forming a solid uncut rear portion.

The invention is further concerned with a method of manufacture of a garment in which the principles can be used to manufacture a blouse, a shirt, a jacket or a coat. Once the pattern for one size garment is made following the teachings of this invention, other sizes can also be made by varying the dimensions to take care of different body sizes.

To these ends, the invention consists in the provision of a pattern comprising a pair of vertical sections foldable along a center line to form a mirror image of each other; each section having an upper part and a narrower lower part; the upper part being shaped to form a sleeve and a collar segment; each section being separated at its upper end from the other by a portion of a neck opening; and a single horizontal cut separates each of the upper parts from the narrower lower part of each section; and the cut extends across the breast area of each of the lower parts to the outer end thereof. The invention also contemplates the use of a generally rectangular piece of cloth substantially the same dimension allowing for cutting of pockets and the like from excess cloth.

The invention is also concerned with a garment made from material cut with the aforesaid pattern by sewing a single seam along the cut in each section. The garment generally comprises a pair of front portions, a rear portion and a pair of sleeves, one sleeve extending from each front portion and the rear portion; the front portion including an upper section and a lower section; and the upper section being joined with the lower section and sleeve connected thereto, by a single seam.

OBJECTS AND MAIN FEATURES OF THE INVENTION

A main object of the invention is to manufacture a garment with a minimum number of seams. A further object of the invention is to provide a pattern for a garment which can be made with a single seam for each half complementary unit.

Another object of the invention is to provide a pattern whose dimensions allow for cuting away excess material of a shape and size such as to be useful for making pockets and the like for the finished garment.

These and other related objects, features and advantages of the invention will be more readily understood as the description thereof proceeds particularly when taken with the accompanying drawing wherein:

DESCRIPTION OF THE PREFERRED EMBODIMENTS

Figure 1:
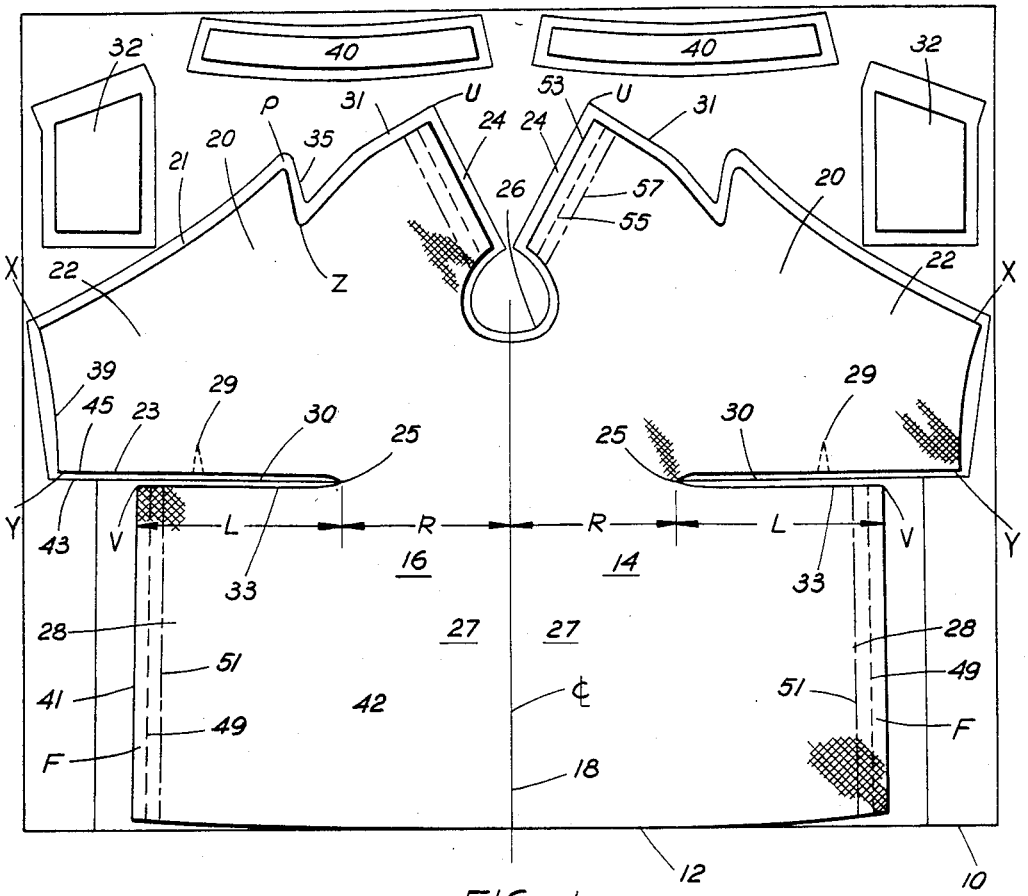
FIG. 1 is a top plan view of a pattern including the component parts of a garment according to the invention placed onto a piece of cloth to be cut to form the individual pieces of an unsewn garment.

Referring to the drawings which illustrate the best mode presently contemplated by me for carrying out my invention, and more particularly, descriptively to FIG. 1, reference number 10 refers to a generally rectangular piece of cloth which is to be cut in conventional fashion according to the shape of pattern 12 placed thereon.

Cloth 10 can be of any material, synthetic or natural, lightweight or heavy, water-repellant or not.

As shown in FIG. 1, pattern 12 includes a pair of identical vertical sections 14 and 16 separated by a center line 18. Section 14 is a right side section, and section 16 is a left side section which is a mirror image of section 14. While 18 is shown and designated as a center line, it can also represent a seam of the right and left sections when these sections are to be made from separate units and then stitched together. However, the seam coincident with center line 18 is only to be used where the cloth is of small dimension insufficient for an entire garment. To speed the manufacturing operation, seam 18 may be eliminated, and single piece of cloth 10 is used to form the complete garment.

Each section has a horizontal upper part 20 which can be folded and shaped to form a sleeve 22 and a part of a collar portion 24.

Each section 14 and 16 is separated from the other by a semi-circular neck portion 26, which together form a substantially complete circular portion for the neck of a wearer of the completed garment. While a circular neck is shown, other neck opening configurations may be used.

Each section 14, 16 has a narrower lower part 28 integral with an upper part 20 except for a single cut 30 extending partially across the breast area of the garment and effectively separating the upper part of the garment from the lower part thereof. The cut 30 is a single cut extending along the lower part 28 to the outer end thereof. Cut 30 on each section separates lower part or section 28 from sleeve 22.

Lower section 28 is intended to cover or surround the lower part of the upper body portion or torso portion generally below the armpits. Portion 29 shown in dashed outline above each single cut 30 exemplifies a portion to be cut out to form a dart 46 (see FIG. 5) which is cut out from the sleeve 22 to form it with the appropriate countour and fit for the wearer. The cutouts 29 to form darts 46 are used in one preferred embodiment of the invention.

The finished garment can be totally conventional with no special features if desired such as a car coat (FIG. 2) or can be styled or decorated according to any current fashion design. More particularly, the sleeves 22 and collar 24 can have whatever design is desirable for a current fashion look. Each section is shown provided with a pocket 32, although it is not necessary. But, advantageously according to the invention when pattern 12 is cut from cloth 10 which is generally rectangular there remains excess material from which pockets 32, collar 24 and collar facing 40 can be cut.

Each vertical section 14, 16 includes a lower part or body portion 42 which extends around the waist, both below and above to approximately the bust line and upper part 20. The single cut 30 generally separates parts 20 and 42.

Figure 2:
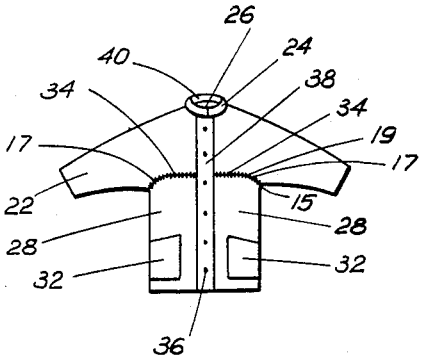
FIG. 2 is a front elevational view of a garment made using the pattern of FIG. 1 as a pattern guide with the individual pieces of the cut material sewn together to form a typical garment according to the invention.
Figure 3:
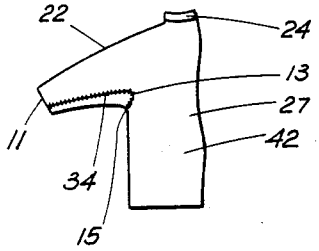
FIG. 3 is a partial rear view of a garment with a minimum number of pieces and a minimum number of cuts and seams to form the back portion and sleeve with a portion of one single continuous seam shown extending from the bottom of the sleeve to a point under the armpit portion and then curving under the armpit portion towards the front.
Figure 4:
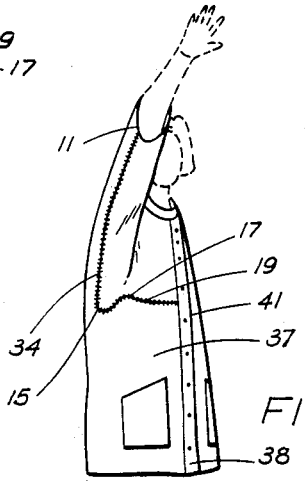
FIG. 4 is a side perspective view of the finished garment on a mannequin with the arm of the mannequin raised to show the single seam extending from the front across the breast portion and then turning substantially orthogonally under the armpit area and extending towards the bottom edge of the sleeve.

Referring now to FIGS. 2 to 4, and as best seen in FIGS. 3 and 4, the rear of the garment shows a single seam 34 which starts at an end 11 of sleeve 22 and extends on the inside of the sleeve up towards the armpit portion of the garment and curves at curvature portion 13 at what would be the beginning edge of the rear 27 of the garment and moves downwardly to a lowermost point 15 substantially separating the rear 27 from the front 37 of the garment and coinciding with a center point from a line which would separate the front 37 from the rear 27 of the garment. To provide for sufficient movement and comfort in the sleeve of the person wearing the garment, seam 34 then (as best seen in FIGS. 3 and 4) rises from the lowermost point 15 up to curvature portion 17 on the front 37 of the garment in such a manner that seam 34 continues substantially horizontally across the breast portion along seam line 19 along the front of the garment towards the front end of the narrower lower part 28. The exact contour of the seam may vary from that exemplified in the drawing, depending upon the material used and the thickness thereof. What is important is that with a single seaming operation for each side a seam is made from the end 11 of sleeve 22 to the front 37 and then along the front of the garment towards the end of lower part 28 to form the sleeve 22 and front portion of the garment with a bust line substantially coincident with seam portion 19 which is a continuation of the single seam on the front 37 of the garment.

To finish the garment, it is only necessary to fold upper sections or parts 20 and to sew their end extremities X and Y together with a single seam 34 (FIG. 2) extending from the open end 39 of sleeve 22 to the edge of the center of the front 37 using a conventional seaming machine. Stitching takes place to form and stitch the two sides opposite the cut-out or single cut 30 through curved portions 13, 15 along 19 towards the front portion of the garment until extremities U and V are sewn together to form a breast panel. Upper edge 21 and lower edge 23 of sleeve 22 are sewn together starting from X and Y up to the end 25 of the single cut 30 to form seam 34 and a closed or sewn sleeve 22 as best seen in FIG. 4. Then, pockets 32 can be sewn to the front of the garment as well as buttons 36 and facing 38 which overlies edge 41 on the front of the garment.

With respect to facing 38, this can be formed as a separate strip which is sewn onto the front of the garment, or it can be formed by folding a facing F (see FIG. 5) along dashed line 49 with edge 41 folded under the garment and sewn to the garment along dot-dashed line 51. In a similar manner, the edge 53 of facing G (See FIG. 5) is folded along dashed line 55 which, when the garment is completed, forms a continuation of dashed line 49, and the edge 53 is then sewn to the garment along dot-dashed line 57 which forms a continuation of line 51, when the garment is completed by sewing the single cut 30 with the single seam 19.

Depending on the girth desired, the length "L" of cut 30 will be greater than the distance "R" from the inner end or end of cut 30 to the center line 18 to provide a front of sufficient width for the body of the finished garment. Portions R, R form the rear of the garment and portions L, L form the front of the garment with end 25 of the single cut separation between the front and rear of the garment. The thin lines 43 show the edges of the material forming the garment folded under to leave a finished edge of the garment identified by thick lines 45, and the dashed lines 49 designate a finished edge when the portion between dashed line 49 and thick line 41 is folded under to form a finished edge.

DESCRIPTION OF CUTTING OPERATION

Figure 5:
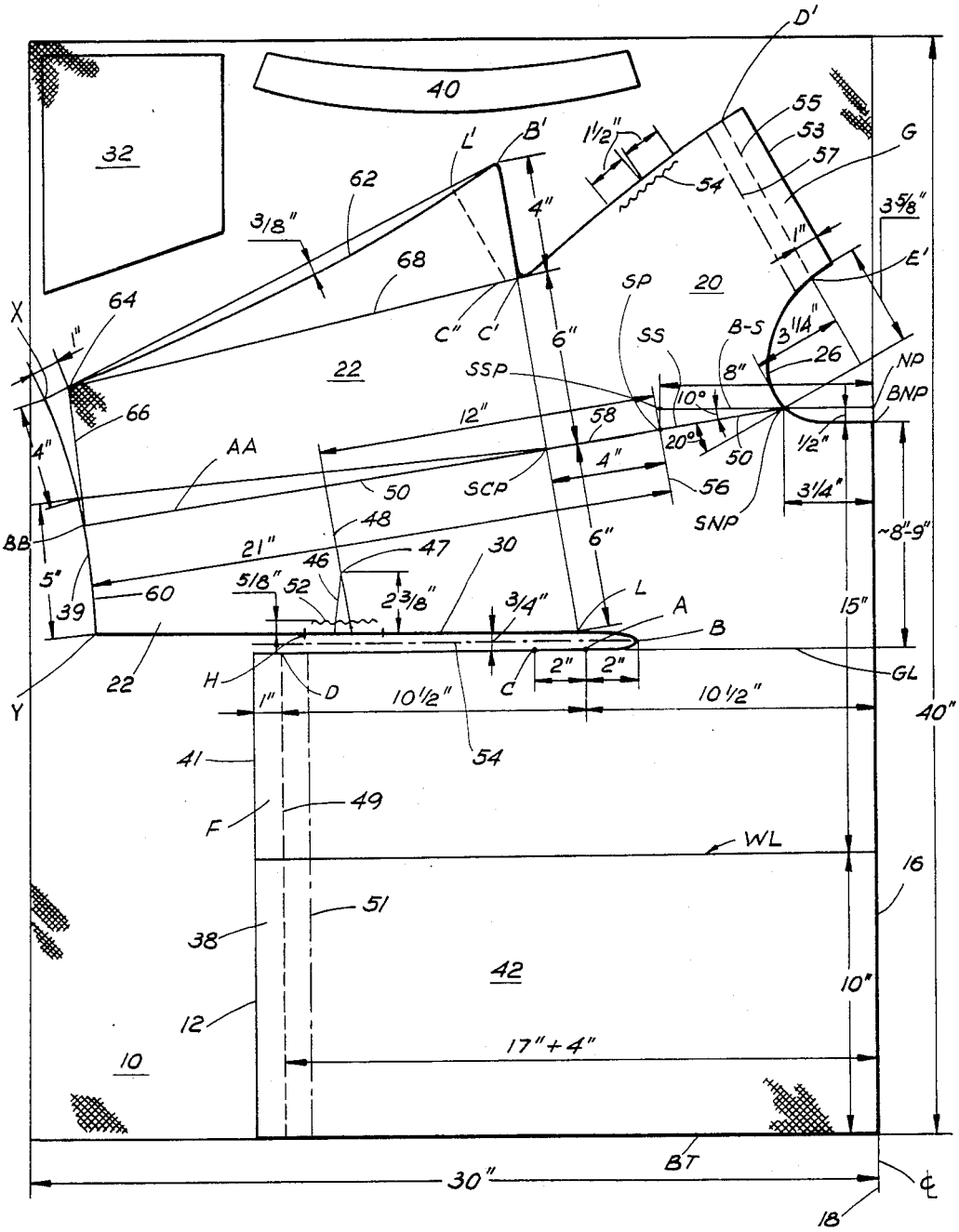
FIG. 5 is a schematic layout of a top plan view of one-half of the pattern shown in FIG. 1 placed onto a piece of cloth to be cut in accordance with the pattern. A left-hand side of the pattern is shown, and the right-hand side pattern being identical to the left-hand side, but the mirror image thereof, and the other parts of the finished garment are also shown placed onto the cloth to be cut.

Referring now more particularly to FIG. 5 which is a left-hand section or half-pattern of the full pattern shown in FIG. 1. The cloth dimension chosen is 40 inches in the vertical direction and 30 inches in the horizontal direction for the half-pattern or 60 inches for the full pattern so that there is no seam 18 in the back.

Therefore, for a typical blouse size 34, line WL illustrates and denotes the approximate waistline area, and this is derived by adding 17 inches which is one-half of 34 inches to 4 inches for a WL dimension of 21 inches, as shown in FIG. 5; the additional 4 inches provides the necessary interior dimension for each half-pattern and the necessary material to form the finished edges. For a more fuller fit, it is possible to add a fourth to one-half inch to each half-pattern. For the full pattern, WL is 42 inches.

As shown, a guide line GL is drawn from the center line 18 parallel to WL and this extends across, as shown, for a width of approximately 21 to 21⅛ inches to point D, depending on the interior room required. A facing portion F which is the same as 38 of about one inch is shown to provide for a facing for buttons; if a zipper is used, this additional one inch portion F may be unnecessary or if a blouse is to be made, facing F may be reduced or eliminated. The guide line GL may extend from center line 18 for a distance greater than 21⅛ inches for a wider look, although 21 inches would be satisfactory for a narrower look, as shown. GL terminates when facing F is reached.

The area at the back of the neck of the wearer determines the point of measurement for the back. For this purpose, a point designated as back neck point BNP is selected, and the distance between BNP and the waistline WL is approximately 15 inches, and the distance between the guide line GL and BNP is approximately eight to nine inches, depending on the rise desired. The distance from the waistline WL to the bottom BT of the garment is 10 inches, but this can be varied depending on the length desired.

The guide line GL can also be considered to be on a line with a bust line, and the bottom of the sleeve under the armpit of a wearer should desirably not be any higher than this point. This is the reason that range of eight to nine inches is provided for an example size 34.

A single cut 30 is made to provide for sleeve 22 separate and apart from lower body portion 42.

The size of cut 30 is carefully selected and follows the following procedure. Point A on guide line GL is approximately midway between the horizontal extent of lower portion 42. For a size 34, this point is approximately 10½ to 10¾ inches from the center line 18 and at least 10½ inches from facing F or 11½ inches from edge 41 of the open front. The dimension of 10½ inches is optimum, but it should be noted that changes in material thickness and the type of fabric may require some slight variation from the 10½ inches dimension. For a size 36, this dimension is approximately 11 inches which is one-fourth of the size plus two inches or the numerical size (36 inches) plus eight inches to provide the necessary interior room and form a dimension twice the waistline WL.

From center point A, points B and C are selected and indicated as being spaced substantially two inches on either side of point A so that the part between points B'–C' of sleeve 22 when seamed will be seamed to the part between points B–C respectively to form an under portion of the seamed sleeve.

The portion B–C on lower body portion 42 cooperates with portion B'–C' to form therewith an under arm portion when the garment is made without a sleeve or that portion of the sleeve which would be under the armpit of a wearer when the garment is made with a sleeve. Portion B'–C' is substantially orthoganol to portion C'–D' which forms one part across the breast portion of the garment.

Cut 30 is shown in exaggerated form spaced on either side of a dot-dashed line 54 with cut 30 being about ¾ inch wide, and this width spacing depends on the fabric used. The spacing can vary between one-half inch to one inch. The four inches dimension or two inches on either side of center point A is related to the side width of the body as this is its approximate thickness. The chest size is generally composed of six different dimensions which require an adjustment to change the size, namely two at the back, two at the front and one for each side of the body.

The difference between sizes 34 and 36 is two inches and this is divided by twelve with the increased dimension of 1/12 being added to each side of each part to provide for the necessary proportionate increase in size. When a garment is to be downsized, the 1/12 of the difference between 34 inches size and the smaller size is subtracted from each side of each part.

Sleeve 22 has its edge 39 shown with extreme portions X, Y which are sewn together with edge X–B' being sewn to edge Y–B, and point D at the outer end of lower part 42 being sewn to point D' to form sleeve the continuous seam 34 substantially across the bust line or line GL extending from sleeve end 11 to the edge 41 of the front of the garment.

The neck point NP and the top of the shoulder or shoulder neck point SNP of a human being is generally about ½ inch higher than the back neck point BNP which is used as a reference point for the back of the neck where the collar starts, and this takes into consideration the thickness of the body.

The shoulder neck point SNP is obtained and selected by the crossing of a first vertical line parallel to center line 18 and spaced horizontally 3¼ inches therefrom and a second horizontal line parallel to waist line WL and passing through the neck point NP. The neck can be selected in accordance with the effects to be obtained, and points D'–E' with facing G forming a continuation of facing F along the front of the garment to form facing 38 thereof (see FIGS. 2 and 4) in its sewn condition. If a zipper is used, facing G may be unnecessary, and here also, the width of G may be varied in the same manner as facing F.

To define and form the neck portion 26, a horizontal line joining a neck point NP and the shoulder neck point SNP is about 15½ inches above WL, and line D'–E' is perpendicular to a line passing through SNP and rotated counterclockwise through an angle of 30° from the NP–SNP line, and spaced 3¼ inches from the widest part of the collar or a line parallel thereto passing through SNP, and the lowermost point E' of the collar is 3⅝ inches from the line rotated through the 30° angle from the horizontal in a counterclockwise direction and passing through SNP.

The shoulder neck point SNP is about the center line of the shoulder, where a shoulder seam or a top shoulder seam normally would start. This is a seam that is no longer necessary and is not shown in the drawing or on the garment in the other figures.

Shoulder point SP is the point at the edge of a top or shoulder portion of the garment where the arm joins the shoulder and where a sleeve is joined to a shoulder portion, except when a raglan sleeve is used. The distance between the shoulder point SP and the shoulder neck point SNP is about 4¾ inches for an average body size, but this will vary depending on whether the individual is large boned or small boned with large or small shoulders. The spacing between the back of the neck NP to the shoulder point SP along the horizontal is eight inches. The shoulder slope line SS is a line substantially defining the approximate top portion of the edge of the shoulder and takes into consideration the slope of the shoulder. To get to shoulder slope line SS which connects shoulder point SP and shoulder neck point SNP, it is necessary to make a counterclockwise rotation of a line B–S passing through SNP and BNP through an angle of 10°. Accordingly, point SP is on a line rotated counterclockwise 10° about a center which coincides with shoulder neck point SNP as a center of rotation. The shoulder slope line SS terminates in a point designated shoulder slope point SSP which is shown as being displaced from the shoulder point SP.

SCP is the shoulder connection point and this is obtained by extending a line connecting B′–C′ in the direction of point B and to point L which substantially coincides with lowermost point 15, and extending a line from shoulder point SP perpendicular to the line joining B′C′–L. Shoulder connection point SCP is spaced four inches from shoulder slope point SS.

When no sleeve is used, there is a portion of the material between B′–L′ which is sewn to B–L to form the portion under the arm or the armpit. Of course, when a sleeve is used, L′ forms with L the lowermost point 15 under the arm and is part of the seamed sleeve. When no sleeve is used, then there is the portion B′–L′–C″–C′ which forms the under arm portion and completes the sleeveless garment. When a sleeve forms part of the garment, of course, the portion circumscribed by B′–L–′–C″–C′ forms part of the sleeve. Also, depending on the size of the opening for the arm, points C′ and C″ may coincide or be slightly spaced from each other and is sewn to lower part 42 in the vicinity of C.

Line AA which extends between BB and shoulder connection point SCP is at the approximate outer center of the unsewn sleeve and extends from point SCP to point BB on edge 39 of the sleeve. By approximate center of the sleeve, it is intended to mean a line extending from the shoulder downwardly opposite to the seam 34 which appears under the arm, but shown in the raised position in FIG. 4. The bottom of the sleeve is 21 inches (53½ cm) from line 56 passing through point SP and perpendicular to line 58 connecting points SCP and SS. This is the normal manner in which a conventional sleeve length is selected for a regular size and from which measurements are made. If a shorter sleeve is to be used, then the measurements are still made on this sleeve length.

In order to obtain a better sleeve appearance, measure up about one inch perpendicularly from line 60 joining X–Y along the side 62 to point 64 and extend a line 66 perpendicularly to a line 68 passing through point 64 and C′ until line 66 meets the edge 39 of the sleeve at point BB. Then line 70 is drawn from point SC perpendicularly to line 66 to define point CC, and thus forms a new center line CC–SC. This new center line CC is about five inches from corner or point Y and four inches from corner or point X and will assure placement of seam 34 hidden under the arm when it is lowered. Even if the sleeve is to be foreshortened so as to be either above or below the elbows, the measurement of the sleeve is made in the aforesaid manner so that the bottom edge 39 will have the proper contour provided point CC is on smoothly curved edge 39 between Y and CC and CC and X.

In order to provide for dart 46, the upper centerpoint 47 thereof is approximately 2⅜ inches from single cut 30 and spaced 12 inches from line 48 passing through dart centerpoint point 47 and perpendicular to line 50 rotated 10° from the horizontal. The size of dart 46 is the difference between X–B′ length and Y–B length.

Between H and I is the area of the sleeve to cover the elbow, and the fabric is adjusted for the movement of elbow. Areas between H and I is about 12 inches from point SS. The cut in the dart 46 provides for the necessary curve together curving the portion between X–B′ so that the lowest part of the curve is ⅜ of an inch below the straight line connecting X–B′.

Moving down counterclockwise 20° from the line connecting points SS to SNP provides another line which, when drawn through SNP and is extended 3¼ inches from the neck, defines the top of the center line of the front, and a line perpendicular thereto passing through and connecting E′–D′ forms the center line for the front of the garment.

Ease portions 52 and 54 shown by the zig-zag line are provided to make the material smooth to fit into the bottom line.

The distance between points B′ and C′ is about 4 inches, and the distance between points L–C′ is about 12 inches with point SC being at the approximate center between L–C′.

The single seam 34 starts at X and moves towards turning point P (B′) then reverses direction by turning approximately 90° towards point Z (C′) which is connected and sewn to end 25 of the single cut to provide a seaming of edge Y–25 to edge X–P–Z to form the sleeve 22, and then seaming takes place between point Z (C′) and point U (D′) to seam top of breast portion or panel 31 between the end of the single cut 25 to extremity V of the lower breast panel 33. The portion between Z–U of the upper breast panel 31 and 25–V of the lower breast panel 33 forms the seam portion 19, and the portions 13, 15 are formed by the stitching of P–2 to the sleeve portion ending at 25.

The foregoing description and the accompanying drawing are believed to clearly disclose a preferred embodiment of the invention but it will be understood that this disclosure is merely illustrative and that changes in the invention may be made which are within the scope of the following claims.

What is claimed is:

1. A garment comprising:

a pair of front portions and a single rear portion;

said rear portion being solid, seamless, and free of any cuts, said rear portion having two rear sleeve parts, one for each arm;

each said front portion including an upper section and a lower section which is divided by a single cut; and on each said front portion, a single continuous seam seaming and joining said upper section with said lower section;

each said single seam on said front portion joining said upper and said lower section commences and extends continously between a free edge of said sleeve parts towards a free edge of said front portion and passes curvilinearly under a portion forming an under arm portion of the garment and extends towards said rear portion.

2. The garment according to claim 1, including a pair of sleeves, one sleeve extending from each said front portion and said single rear portion, each said sleeve having a first part thereof joined with said rear portion and a second part joined with a respective one of said front portions, and said single seam joining said upper section with said lower section being continuous with and including a first seam part joining said second portion with said front portion and a second seam part joining said first part with said rear portion to provide a single continuous seam for each sleeve joining each said sleeve with said upper and said lower sections.

3. The garment according to claim 2, wherein said single seam for each said sleeve is on the portion of said sleeve proximate to and facing said front and rear portions and extends under the armpit portion of the sleeve from a lowermost point substantially separating said rear portion from both pairs of front portions and coinciding with a center point from a line which would separate the front from the rear of the garment, said seam turns orthogonally under the armpit;

said single seam starting at an end of the sleeve and extends on the inside of the sleeve up towards the armpit portion of the garment and curves at a first curvature at what would be the beginning edge of the rear of the garment;

said seam rising from a lowermost point up to a second curvature on the front of the garment and then continuing with a bust line substantially coincident with the seam portion.

4. The garment of claim 1, including a neck portion having a collar facing on each of said front portions extending from said neck portion to said single seam joining said upper section with said lower section.

5. The garment of claim 4, including an under arm portion connected with said upper section of said front portion in the unsewn condition of the garment, said under arm portion being connected with the upper section of said front portion and extending substantially orthogonal thereto in an unsewn condition of the garment, and being connected with the lower portion and extending therewith in the sewn condition underneath the armpit of the wearer.

6. The garment according to claim 3, wherein:

each said upper section includes a part neck opening and a collar facing, said rear portion of the garment also including a part neck opening which together with the neck opening of each said upper sections forms the neck opening for the garment;

the breast portion extending substantially orthogonally to said collar facing and forming with a first part of said lower section a seamed portion across the breast portion of the garment; and an underarm portion extending substantially orthogonally to said breast portion and in substantially the same direction as said collar facing and forming with a second part of said lower section a seamed portion under the arm continuous with the seam across the breast and said sleeve.

7. The garment of claim 6, wherein said sleeve in its unsewn condition extends from said rear portion and said upper section of said front portion, and said single seam extends on the portion of the sleeve facing a continuation between the rear and front portion of the garment and extends upwardly along the sleeve portion facing the body portion to said under arm portion towards said collar facing.

8. The garment according to claim 3, wherein said single seam closes the sleeve extending from the outer edge thereof to a point joining the said upper section to said lower section and to said rear portion and then extends along the front of said garment.

9. A pattern for manufacturing a garment with a single seam across each half front part, comprising:

a pattern shape composed of a pair of vertical sections foldable along a center line to form a mirror image of each other;

each said section having a front portion and a rear portion, said front portion including an upper part and a narrower lower part and said rear portion including part of a back portion;

said rear portion being outlined shaped to form with said back portion a collar segment and said upper part being shaped to form an arm portion;

each section when joined together being separated at its upper end from the other by a portion to provide for a neck opening; and a portion delineating a single horizontal cut outline to define a separation of each of said upper part from said narrower lower part of each said section and delineating said upper part from said lower part;

said cut outline extending on said pattern shape across the breast area of each of said lower parts to the outer end thereof.

10. The pattern of claim 9, wherein said arm portion includes sleeve segments extending horizontally beyond the extremities of said lower parts.

11. The pattern of claim 9, wherein each section has a portion to define a continuous area extending from said cut outline towards the center line to form a solid uncut rear portion.

12. The pattern of claim 9, wherein:

said upper part is separated from said lower part by a guide line substantially coincident with a bust line of a garment to be made using the pattern;

said single horizontal cut having a length substantially equal to one-half the waist line dimension of the finished garment plus a portion equal to one-half an under arm portion; and said upper part including an upper part edge portion having the same dimension as the under arm portion, a breast edge portion having the same dimension as one-half the waist line dimension.

13. The pattern of claim 9, including:

a back neck point BNP and a waist line dimension from which measurements are to be laid out, said back neck point being approximately fifteen inches along a center line orthogonal to the waistline and thereabove to locate the approximate back of the neck of the wearer of a garment to be made;

a guide line between said waistline and said back neck point approximately eight to nine inches from said BNP, and the single cut separating said upper part from said lower part being substantially coextensive with said guide line and having a center point defining the under arm portion with a sleeve portion opening extending from one side of said center point and a bust line extending from the other side of said center point with the center point forming the lowest under arm point;

obtaining a shoulder neck point SNP by crossing a first vertical line parallel to the center line of the back of the end spaced horizontally 3¼ inches therefrom and a second horizontal line parallel to the waist line;

obtaining a shoulder point SP to define the edge of a shoulder portion of the garment where the sleeve is joined to a shoulder portion, which includes obtaining a shoulder slope point SS which is about eight inches along a line parallel to the waist line from the back neck point BNP, and then rotating a line passing through the shoulder neck point SNP through an angle of 10 degrees to obtain the shoulder neck point SP;

obtaining measurements for the sleeve from said shoulder neck point;

obtaining a shoulder connection point SCP by extending a line from a point L defining the lowermost point under the arm of a wearer of the garment orthogonal to the line connecting shoulder point SP with shoulder neck point SNP to define a portion B'–C' on said upper part which is to be sewn to portion B–C on said lower part to form the seam under the armpit;

dimensioning the sleeve from the shoulder connection point SCP and shoulder point SP; and forming a center line for the sleeve by drawing a line which passes through the shoulder connection point SCP perpendicular to a line passing through a line joining one edge of the sleeve and displaced about one inch from the other edge of the sleeve to be joined to the first edge extending along the longitudinal extent under the arm and moving around the back of the arm, along a longitudinally extending part of the sleeve which extends under the arm and extends towards the front of the arm with the other edge of the sleeve being connected with the portion extending under the arm.

14. The pattern of claim 1, including a dart portion formed on said sleeve edge extending from the inner part of the arm and around thereof towards the back of the arm to be joined with the portion extending around the front of the arm, the pattern including a portion to define an area of the sleeve to cover the elbow and permit movement of the elbow.

15. A garment made from material cut with the pattern of claim 9, by sewing a single seam along said cut in each section.

16. A garment comprising:

a pair of front portions and a rear portion;

said rear portion being solid, seamless, and free of any cuts;

each said front portion including an upper section and a lower section separated by a single cut separating said upper section from said lower section and extending substantially across the bust line, said upper portion and said lower section being solid, seamless; and a single seam connecting said upper section to said lower section and extending across said bust line from an edge of the front section towards a point at which said upper section and said lower section are joined together to said rear portion, said single seam rises from a lowermost point up to a curvature point on the front of the garment and extending therefrom across a bust line substantially coincident with said single cut towards an edge of each said front portion.

17. The garment of claim 2, wherein the underarm portion includes first and second curvature portions, and said single seam for each said sleeve parts starts at an end of said sleeve, and extends on the inside of the sleeve up towards the armpit portion of the garment and curves at said first curvature portion, and said second curvature portion being the beginning edge of the rear of the garment joined to the seam portion joining said upper section with said lower section.

18. The garment of claim 1, wherein said sleeve parts include:

a portion forming part of a sleeve;

each said front portion also including a front sleeve part and an extension portion extending from said front sleeve part for connection with said rear sleeve part; and said seam seaming said rear sleeve part with said extension portion to connect said rear sleeve part with said front sleeve part, said front sleeve part along said extension portion so that the seamed sleeve has a seam visible from the rear of the garment and extends from a free end of the seamed sleeve along the sleeve, under the armpit towards the connection of said upper section and said lower section.

19. A garment according to claim 1, wherein said rear portion is a uniformly continuous material free of seams joining adjacent pieces of material together.

20. A garment formed from a single uncut piece of material, comprising:

a pair of front portions and a rear portion joined with said pair of front portions;

said rear portion having a rear sleeve part for each arm of a wearer forming part of an underarm portion which extends under the armpit of the wearer;

each said front portion including an upper section and a lower section which is divided by a single cut; and on each said front portion, a single continuous seam seaming and joining said upper section with said lower section;

said single seam joining said upper and lower sections commences and extends firstly continuously between a free edge of said sleeve part towards a free edge of said front portion and secondly passes under a portion of the sewn garment forming the under arm portion of the garment forming part of said sleeve part and extends in a curvilinear manner on said rear portion proximate to said rear sleeve part while curving under said under arm portion toward said free edge of each of said front portions; and said single seam being on the portion of said sleeve part proximate to and facing said front and rear portions and extends under the armpit portion of the sleeve.

* * * * *